US010539359B2

(12) United States Patent
Kwon et al.

(10) Patent No.: US 10,539,359 B2
(45) **Date of Patent: *Jan. 21, 2020**

(54) REFRIGERATOR AND FOLDING GUIDE DEVICE PROVIDED THEREIN

(71) Applicant: LG ELECTRONICS INC., Seoul (KR)

(72) Inventors: O Min Kwon, Seoul (KR); Ki Young Lim, Seoul (KR)

(73) Assignee: LG Electronics Inc., Seoul (KR)

( * ) Notice: Subject to any disclaimer, the term of this patent is extended or adjusted under 35 U.S.C. 154(b) by 129 days.

This patent is subject to a terminal disclaimer.

(21) Appl. No.: 15/615,950

(22) Filed: Jun. 7, 2017

(65) Prior Publication Data

US 2017/0350637 A1 Dec. 7, 2017

(30) Foreign Application Priority Data

Jun. 7, 2016 (KR) ..... 10-2016-0070545

(51) Int. Cl.
*F25D 23/02* (2006.01)
*F25D 23/04* (2006.01)
*F25D 25/02* (2006.01)

(52) U.S. Cl.
CPC ..... *F25D 23/025* (2013.01); *F25D 23/04* (2013.01); *F25D 25/027* (2013.01); *F25D 2323/023* (2013.01)

(58) Field of Classification Search
CPC ..... F25D 23/025; F25D 23/04
See application file for complete search history.

(56) References Cited

U.S. PATENT DOCUMENTS 6,484,529 B2 * 11/2002 Dasher ..... F25D 23/02 62/344
7,430,111 B2 * 9/2008 Lee ..... F16M 11/2092 312/406
7,654,107 B2 * 2/2010 Okuda ..... E05F 7/005 312/401
8,322,805 B2 * 12/2012 Kwon ..... F25D 23/025 312/275
8,851,589 B2 * 10/2014 Gwak ..... F25D 23/04 312/292

(Continued)

FOREIGN PATENT DOCUMENTS

EP 2677258 A2 * 12/2013 ..... F25D 23/04

*Primary Examiner* — Kimberley S Wright
(74) *Attorney, Agent, or Firm* — Fish & Richardson P.C.

(57) ABSTRACT

Disclosed are a refrigerator and a folding guide device provided therein. The refrigerator includes a body including a storage compartment, a door that opens and closes the storage compartment, a support provided to be changeable in position to an unfolded position to be unfolded outward from the storage compartment and a folded position to be folded in the storage compartment, a folding guide device interlinked with an opening and closing operation of the door to apply a rotational force for changing the position of the support to the support. Here, the folding guide device includes a slider pressurized by the door and linearly moved, and a conversion outputter provided to connect the slider with the support and configured to convert a linear force input by the slider that linearly moves into a rotational force for changing the position of the support and output the rotational force.

20 Claims, 13 Drawing Sheets

(56) References Cited

U.S. PATENT DOCUMENTS

| | | | | |
|---|---|---|---|---|
| 8,944,534 | B2 * | 2/2015 | Lim | F25D 23/028 312/292 |
| 9,879,901 | B2 * | 1/2018 | Lim | F25D 23/025 |
| 10,113,789 | B2 * | 10/2018 | Yu | F25D 25/027 |
| 2001/0035024 | A1 * | 11/2001 | Dasher | F25D 23/02 62/440 |
| 2006/0226750 | A1 * | 10/2006 | Lee | F25D 23/02 312/405.1 |
| 2008/0034778 | A1 * | 2/2008 | Lim | F25D 25/02 62/340 |
| 2008/0066481 | A1 * | 3/2008 | An | F25D 23/028 62/265 |
| 2009/0277209 | A1 * | 11/2009 | Jang | F25D 11/006 62/441 |
| 2010/0308705 | A1 * | 12/2010 | Kwon | F25D 23/025 312/404 |
| 2012/0180395 | A1 * | 7/2012 | Yamaguchi | E05F 1/14 49/359 |
| 2013/0119849 | A1 * | 5/2013 | Gwak | F25D 23/04 312/405.1 |
| 2013/0147337 | A1 * | 6/2013 | Lim | F25D 23/028 312/404 |
| 2016/0273825 | A1 * | 9/2016 | Lim | F25D 23/025 |
| 2017/0299256 | A1 * | 10/2017 | Yu | F25D 25/027 |

* cited by examiner

REFRIGERATOR AND FOLDING GUIDE DEVICE PROVIDED THEREIN

CROSS-REFERENCE TO RELATED APPLICATION

This application claims priority to and the benefit of Korean Patent Application No. 10-2016-0070545, filed on Jun. 7, 2016, the disclosure of which is incorporated herein by reference in its entirety.

BACKGROUND

1. Field of the Invention

The present invention relates to a refrigerator and a folding guide device provided therein, and more particularly, to a refrigerator that stores items such as food and the like and a folding guide device provided therein.

2. Discussion of Related Art

Generally, a refrigerator is an apparatus that decreases a temperature in a compartment by discharging cool air generated by a refrigerating cycle including a compressor, a condenser, an expansion valve, an evaporator, and the like to keep food and the like frozen or refrigerated.

Refrigerators generally include a freezing compartment that keeps foodstuffs, such as food, beverages, or the like, or other items frozen and a refrigerating compartment that keeps items at low temperature as storage compartments.

The above-described refrigerators may be classified into a top mounting type in which a freezing compartment is disposed above a refrigerating compartment, a bottom freezer type in which a freezing compartment is disposed below a refrigerating compartment, and a side by side type in which a freezing compartment and a refrigerating compartment are partitioned into left and right sides depending on an arrangement of a freezing compartment and a refrigerating compartment.

Recently, to efficiently utilize a storage space, refrigerators having a form in which a door rack or a storage case forming a space that stores items is provided inside a refrigerating compartment door have been released.

In the above-described refrigerators, a storage case provide inside a door as a space separate from a storage compartment is referred to as a home bar or an auxiliary storage compartment.

Also, an opening is formed at the refrigerating compartment door and a sub door capable of opening and closing the opening is mounted thereon to access the auxiliary storage compartment without opening the entire refrigerating compartment by opening the door.

According to this, doors may be divided into a main door and a sub door and a door that opens and closes the refrigerating compartment may be referred to as the main door while the sub door may be a door that opens and closes the auxiliary storage compartment The sub door may be provided to have the same size as the main door or to be smaller than the main door, and may be mounted to be vertically pivotable based on a horizontal axis or pivotable leftward and rightward based on a vertical axis.

A user may access the auxiliary storage compartment through the opening of the main door by opening only the sub door to insert or withdraw a beverage or food into or from the auxiliary storage compartment.

However, refrigerators having the above-described configuration have a limitation in providing an adequate space or structure for temporarily storing retrieved items when withdrawing items located deep inside a storage compartment or an auxiliary storage compartment to change positions thereof, pouring a beverage into a cup, or putting food stored in the storage compartment or auxiliary storage compartment into another container while the storage compartment or the auxiliary storage compartment is filled with items.

SUMMARY OF THE INVENTION

It is an aspect of the present invention to provide a refrigerator capable of providing a holding structure for temporarily holding retrieved items and a folding guide device provided therein.

According to one aspect of the present invention, a refrigerator includes a storage compartment, a cabinet that forms at least a part of the storage compartment, a door installed at the cabinet to open and close the storage compartment, a support provided to be changeable in position to an unfolded position to be unfolded outward from the storage compartment and a folded position to be folded in the storage compartment, to be changed in position to the folded position by a pressure applied by a closing operation of the door, and to be changed in position to the unfolded position when the applied pressure is released by an opening operation of the door, and a folding guide device interlinked with the closing operation of the door to apply a pressure for changing the position of the support at the unfolded position to the folded position to the support.

The support may be installed at the cabinet to be pivotable to the unfolded position and the folded position.

The door may include a main door that is pivotably installed at the cabinet to open and close the storage compartment and includes an opening therein, and a sub door pivotably installed at the main door to open and close the opening. The support may be installed at one or more of the cabinet or the main door.

The door may include the main door that is pivotably installed at the cabinet to open and close the storage compartment and includes the opening therein, and the sub door pivotably installed at the main door to open and close the opening. The storage compartment may include a main storage compartment formed in a space in the cabinet and a sub storage compartment formed in a space between the sub door and the main storage compartment. The support may be installed at the main door to be erect at the folded position and positioned in the sub storage compartment, and to be unfolded outward from the sub storage compartment at the unfolded position.

The door may include the main door that is pivotably installed at the cabinet to open and close the storage compartment and includes the opening therein, and the sub door pivotably installed at the main door to open and close the opening. The storage compartment may include the main storage compartment formed in the space in the cabinet and the sub storage compartment formed in the space between the sub door and the main storage compartment. The support may be installed at the main door to be erect at the folded position and positioned in the cabinet, and to be unfolded outward from the main storage compartment at the unfolded position.

The refrigerator may further include a position maintainer that restricts a movement of the support to maintain a position of the support that has been changed to the unfolded position or the folded position.

The supporter may be erect to tilt outward from the storage compartment to receive a force for pivoting in a direction of being laterally unfolded at the folded position.

The position maintainer may further include an elastic pressurizer that provides an elastic force applied in a direction that allows the support to tilt outward from the storage compartment.

The position maintainer may include a lateral supporting wall that supports a bottom surface of the support from below to allow the support to remain in a state of being laterally unfolded at the unfolded position, and a longitudinal supporting wall that supports the bottom surface of the support from a front side to allow the support to remain in a state of being longitudinally erect at the folded position, and the elastic supporter may include an elastic member installed at the longitudinal supporting wall to be positioned between the longitudinally erect support and the longitudinal supporting wall.

The position maintainer may further include a supporting rib that supports a top surface of the support from above at a rear side of the longitudinal supporting wall to allow the support to remain in the state of being laterally unfolded at the unfolded position.

The folding guide device may include a slider provided to be movable to a protruding position and a depressed position and pressurized by the door that closes the storage compartment to be moved to the depressed position, and a conversion outputter that is provided to connect the slider with the support, outputs a linear force input by the slider that moves to the depressed position as a rotational force in one direction for changing the position of the support to the folded position, and outputs a rotational force in the other direction input by the support that has been changed in position to the unfolded position as a linear force for returning the slider to the protruding position.

The refrigerator may further include a pressurizing protrusion provided to protrude from the door and configured to move with the door when the closing operation of the door is performed to pressurize the slider positioned at the protruding position toward the depressed position.

The pressurizing protrusion may include a protrusion body formed to have a shape protruding from a rear surface of the door and a contactor provided on an outer surface of the protrusion body and in contact with the slider The protrusion body may be formed of a metal material having high rigidity, and the contactor may be formed of a material that reduces a coefficient of friction between the slider and the contactor.

According to another aspect of the present invention, a folding guide device may include a slider provided to be movable to a protruding position and a depressed position and pressurized by a door that closes a storage compartment formed in a cabinet to be moved to the depressed position, and a conversion outputter which is provided to connect a support provided in the storage compartment with the slider to change a position thereof to an unfolded position to be unfolded outward from the storage compartment and a folded position to be folded into the storage compartment, outputs a linear force input by the slider that moves to the depressed position as a rotational force in one direction for changing the position of the support into the folded position, and outputs a rotational force in the other direction input by the support that has been changed in position into the unfolded position as a linear force for returning the slider to the protruding position.

The folding guide device may further include a damper that provides a damping force for reducing the rotational force in the other direction input to the conversion outputter.

The folding guide device may further include elastic supporters that provide an elastic force applied in a direction that blocks a movement of the slider moved toward the protruding position.

The folding guide device may further include a case that accommodates the conversion outputter and the elastic supporters therein and in which the slider is movably accommodated, guide pins installed in the case, combined with the slider, and configured to guide a movement path of the slider that moves between the protruding position and the depressed position, and a combiner that combines the slider with the guide pins to be slidably movable.

The elastic supporters may provide an elastic force applied in a direction that blocks a movement of the combiner moved with the slider moved toward the protruding position.

Each of the elastic supporters may include a coil spring provided to be put around the guide pin to be positioned at a movement path of the combiner and be compressible by the combiner moved toward the protruding position along a movement direction of the combiner.

The coil spring may be installed to be positioned between the combiner and a wall surface of the case positioned adjacent to the slider moved toward the protruding position.

The elastic supporters may apply the elastic force to the slider in the direction that blocks the movement of the slider that is moving a certain distance toward the protruding position of the slider.

The guide pins may include a spring mounting pin which the coil spring is put around and a sliding pin with which the combiner is slidably combined.

The guide pins may include a pair of such spring mounting pins spaced a certain interval apart, and the sliding pin may be disposed between the pair of spring mounting pins.

The combiner may include first through holes formed to pass through the combiner to allow the spring mounting pins to pass through the combiner, and a second through hole formed to pass through the combiner to allow the sliding pin to pass through the combiner, and the second through hole may be formed to have an inner diameter corresponding to an outer diameter of the sliding pin to allow an inner circumferential surface of the combiner at which the second through hole is formed to come into contact with the sliding pin.

Each of the first through holes may include a through hole formed to have an inner diameter that allows the spring mounting pin to be passable therethrough, and an extension hole formed to have an inner diameter larger than that of the through hole to allow the coil spring put around on the spring mounting pin to be passable therethrough.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
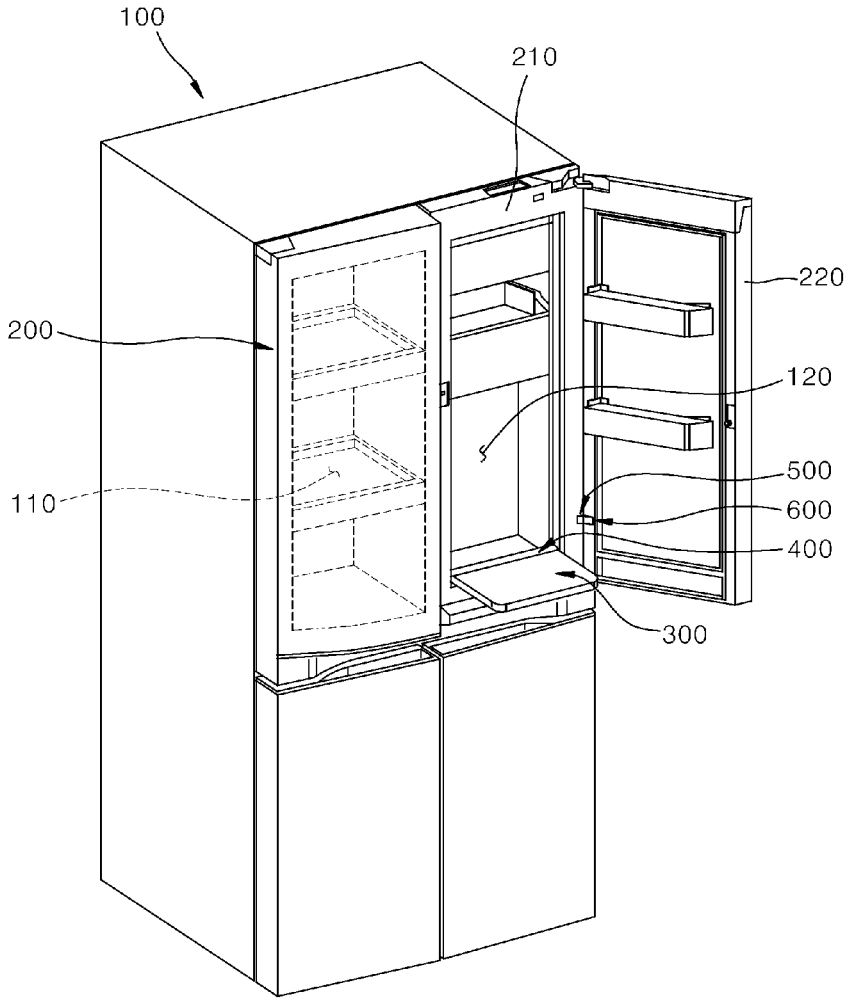
FIG. 1 is a perspective view of a refrigerator according to one embodiment of the present invention.

Hereinafter, a refrigerator according to embodiments of the present invention and a folding guide device provided therein will be described with reference to the attached drawings. For convenience of description, thicknesses of lines, sizes of components, or the like shown in the drawings may be exaggerated for clarity and convenience of description. Also, the terms described below are defined in consideration of functions thereof in the present invention, which may vary with intentions of a user and an operator or practice. Accordingly, the definitions of such terms should be understood based on the content throughout the specification.

Figure 2:
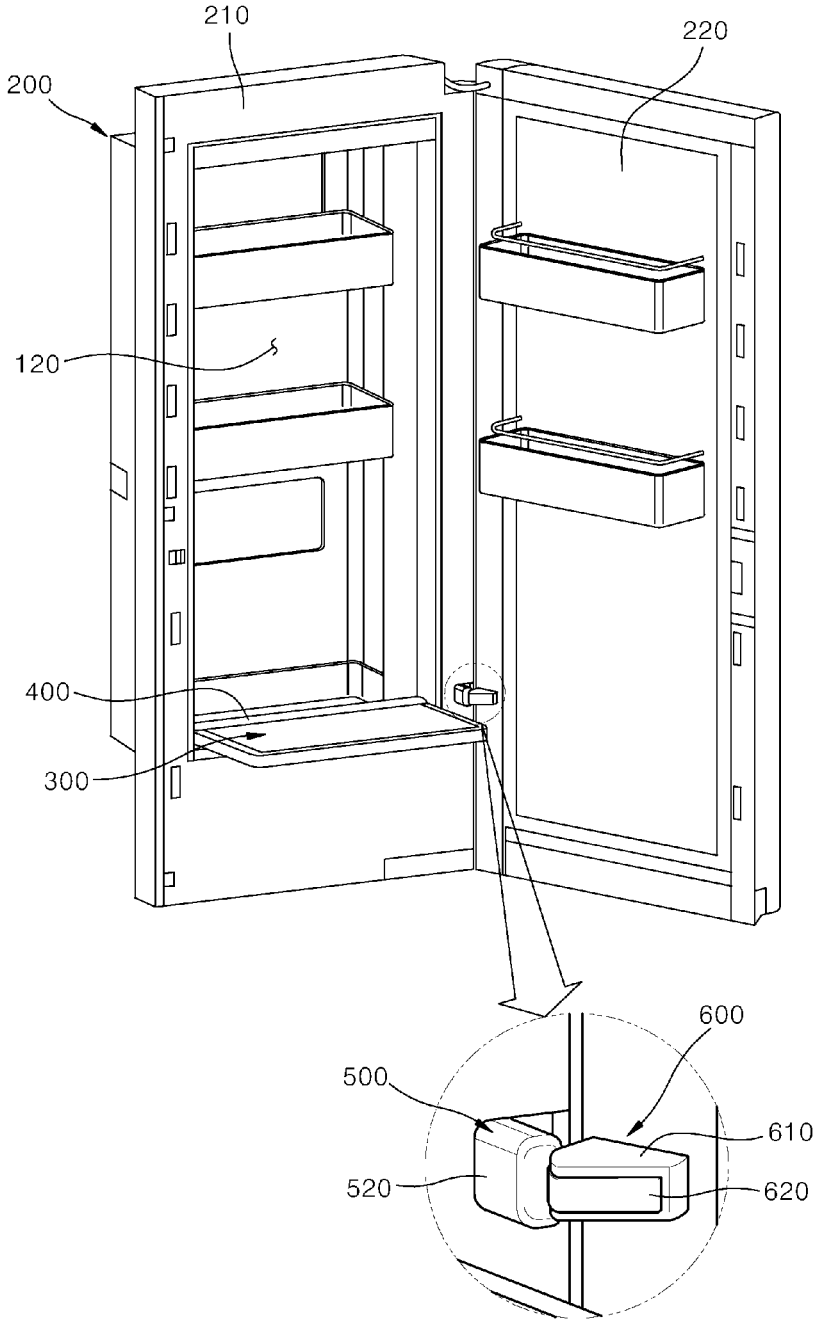
FIG. 2 is a perspective view illustrating a main door and a sub door that are separated from each other and shown in FIG. 1.
Figure 3:
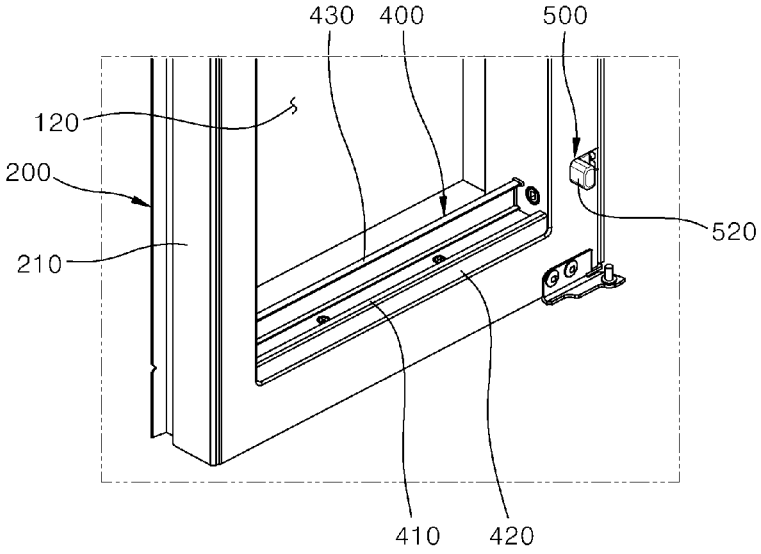
FIG. 3 is a perspective view illustrating a structure of a position maintainer shown in FIG. 2.
Figure 4:
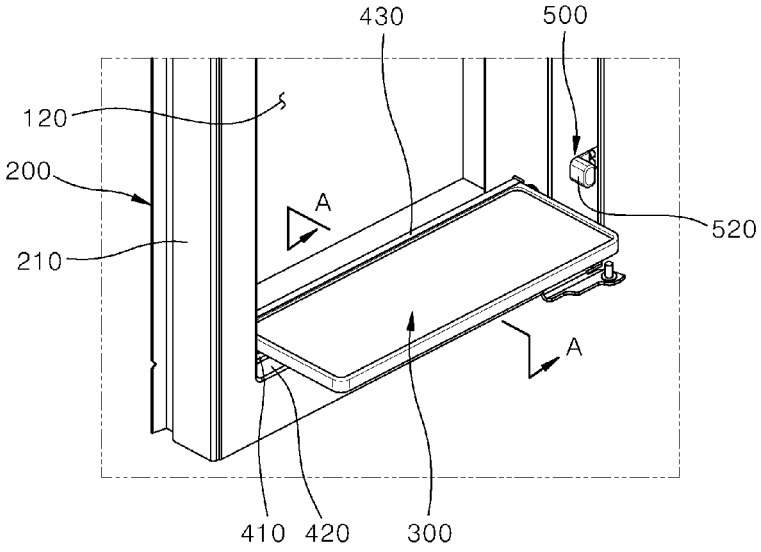
FIG. 4 is a perspective view illustrating a structure in which a support is installed at the position maintainer shown in FIG. 3.
Figure 5:
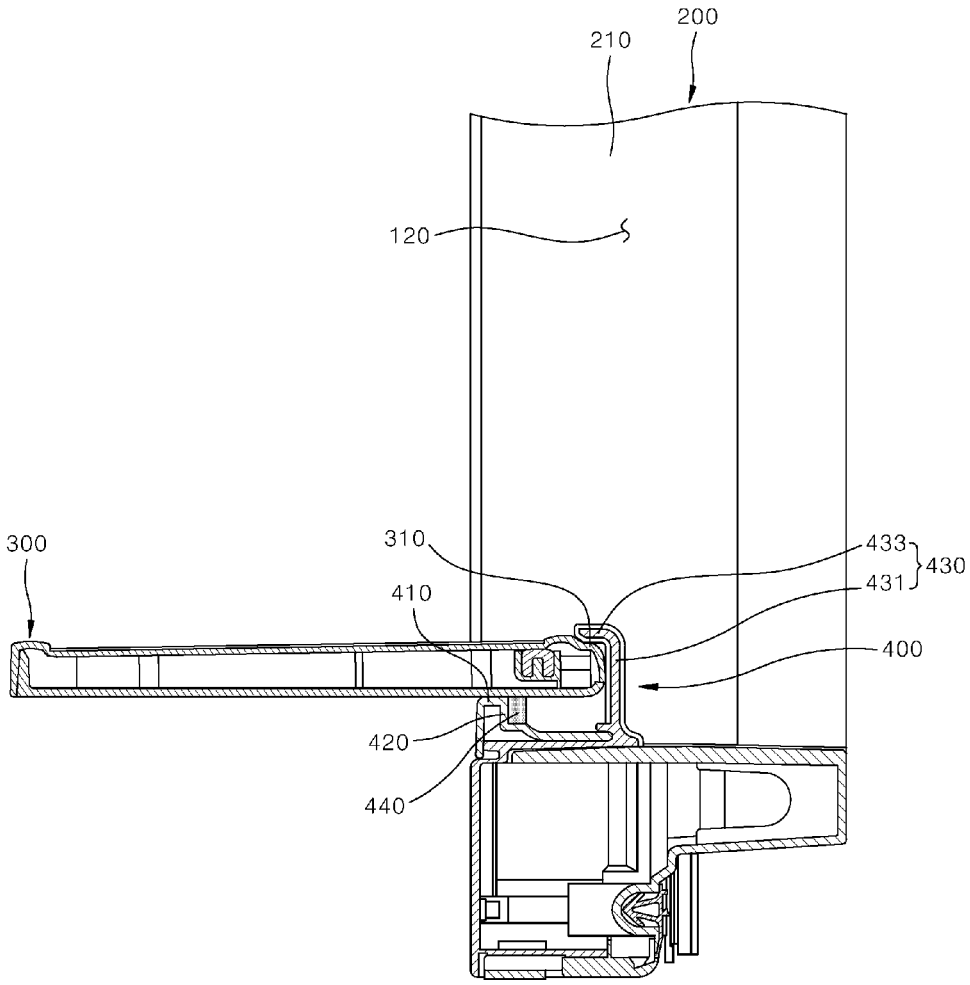
FIG. 5 is a cross-sectional view illustrating a part taken along line A-A of FIG. 4.
Figure 6:
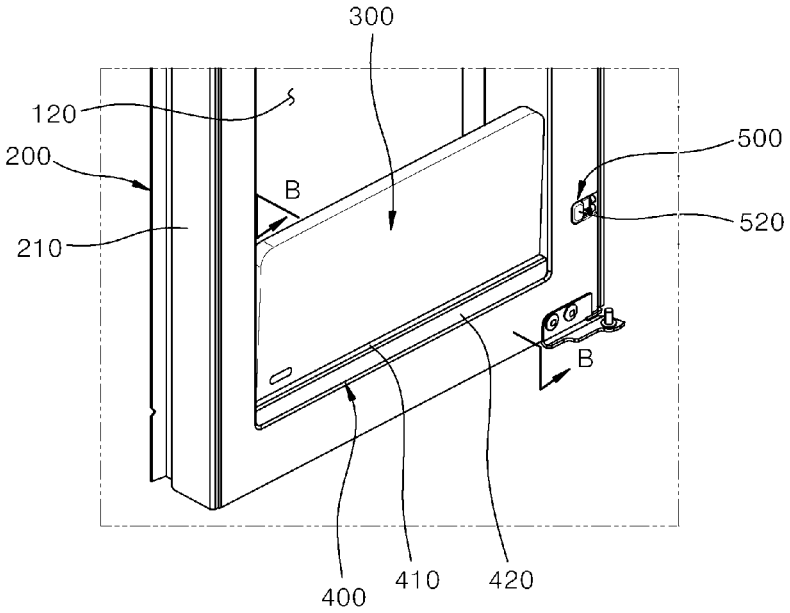
FIG. 6 is a perspective view illustrating a state in which a position of the support shown in FIG. 4 is changed to a folded position.
Figure 7:
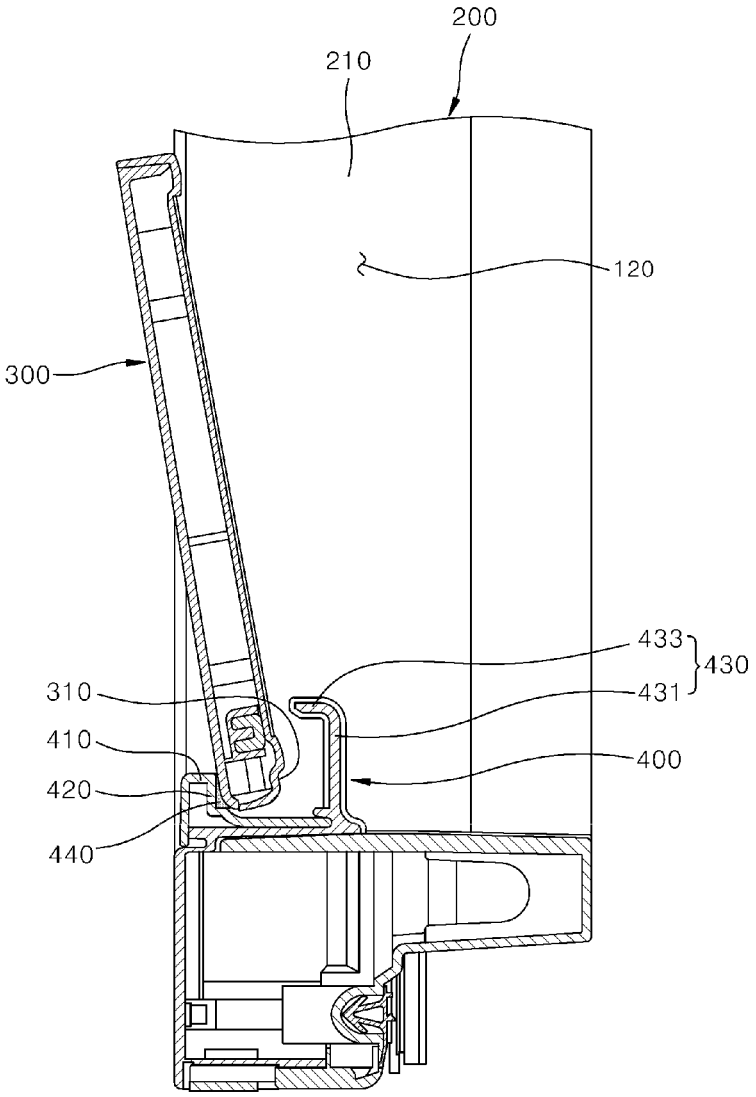
FIG. 7 is a cross-sectional view illustrating a part taken along line B-B of FIG. 6.
Figure 8:
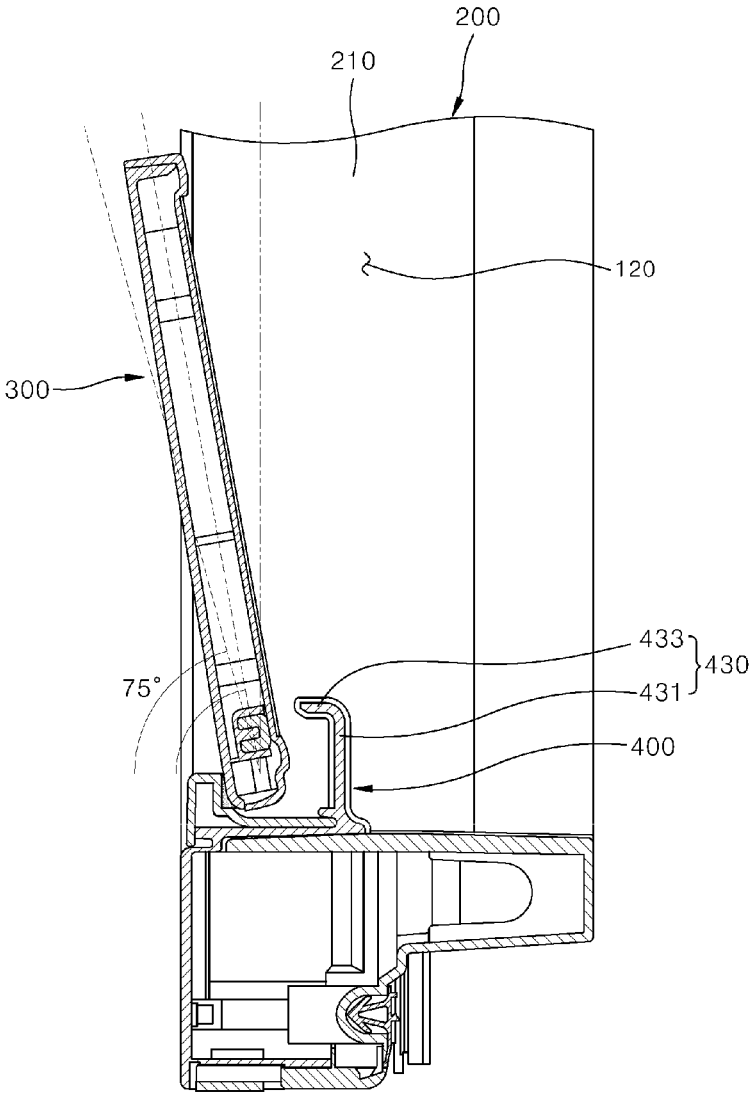
FIG. 8 is a view illustrating a tilting range of the support shown in FIG. 7.
Figure 9:
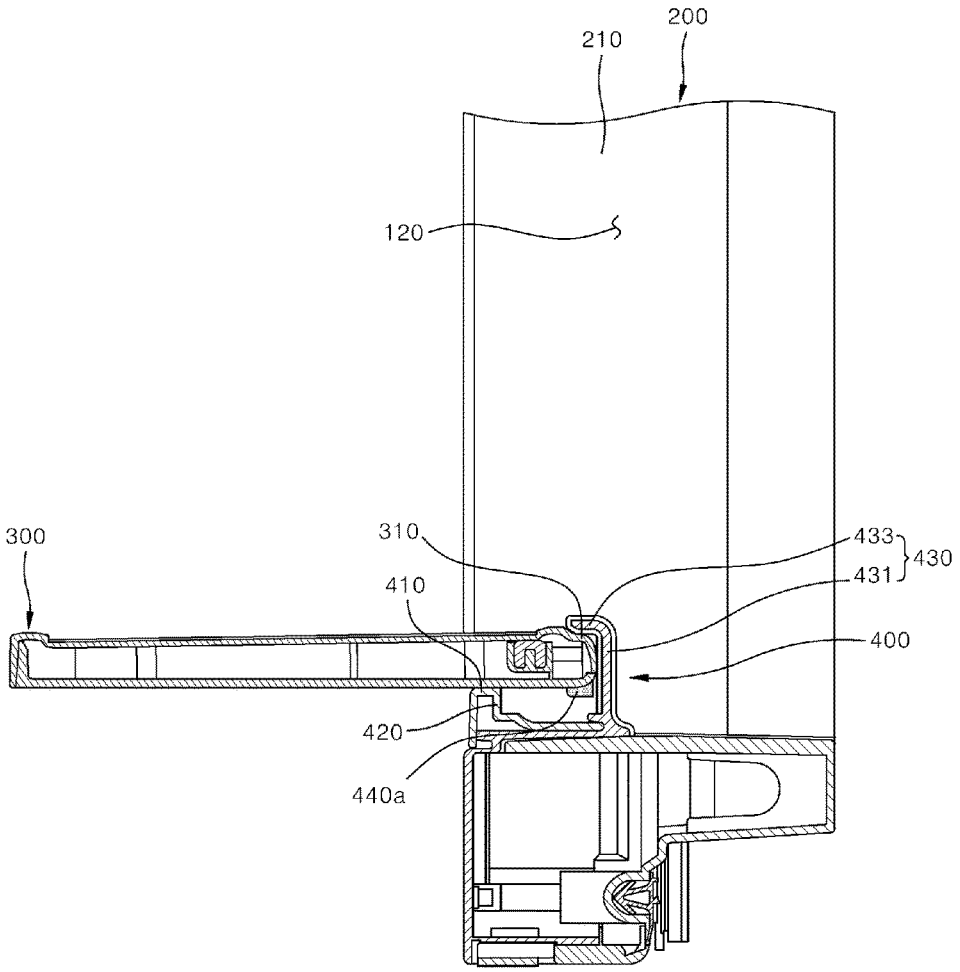
FIGS. 9 and 10 are views illustrating another embodiment of an elastic pressurizer.
Figure 10:
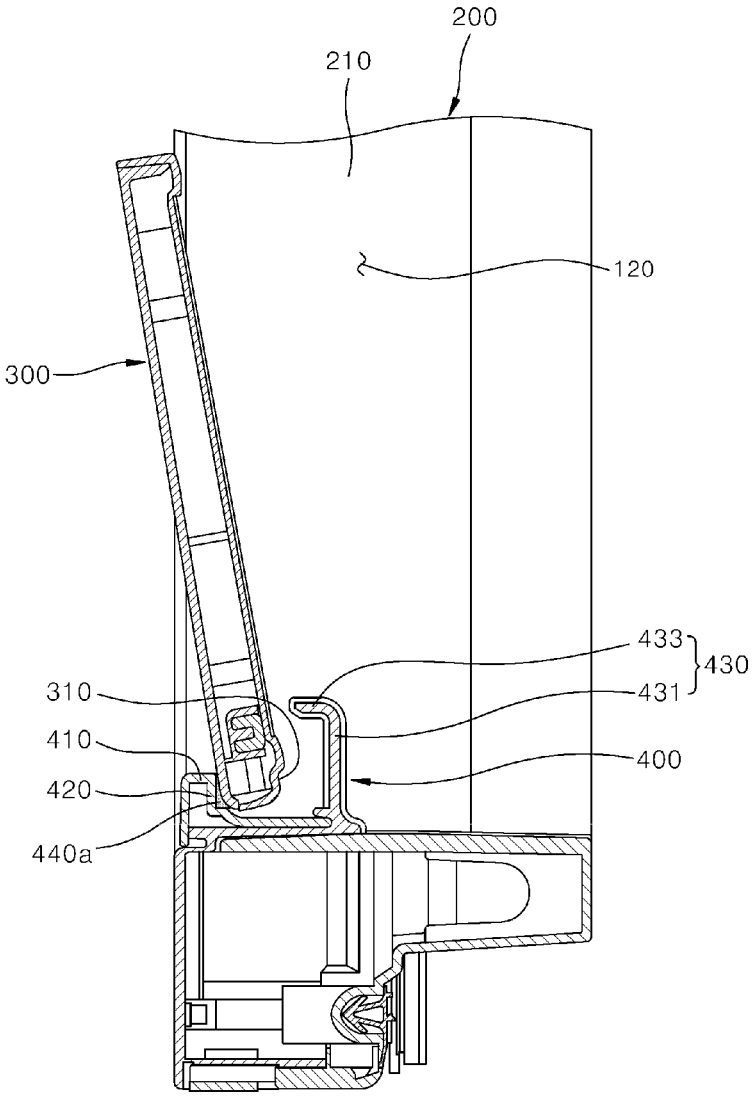

FIG. 1 is a perspective view of a refrigerator according to one embodiment of the present invention, FIG. 2 is a perspective view illustrating a main door and a sub door that are separated from each other and shown in FIG. 1, FIG. 3 is a perspective view illustrating a structure of a position maintainer shown in FIG. 2, FIG. 4 is a perspective view illustrating a structure in which a support is installed at the position maintainer shown in FIG. 3, FIG. 5 is a cross-sectional view illustrating a part taken along line A-A of FIG. 4, FIG. 6 is a perspective view illustrating a state in which a position of the support shown in FIG. 4 is changed to a folded position, FIG. 7 is a cross-sectional view illustrating a part taken along line B-B of FIG. 6, FIG. 8 is a view illustrating a tilting range of the support shown in FIG. 7, and FIGS. 9 and 10 are views illustrating another embodiment of an elastic pressurizer.

Referring to FIGS. 1 and 2, the refrigerator according one embodiment of the present invention includes a cabinet 100, a door 200, a support 300, a position maintainer 400, and a folding guide device 500.

The cabinet 100 is provided to form an external frame of the refrigerator with the door 200, and storage compartments 110 and 120 are formed in the cabinet 100.

In the embodiment, for example, a bottom freezer type refrigerator in which a refrigerating compartment is provided above and a freezing compartment is provided below as storage compartments in the cabinet 100 will be described.

However, the present invention is not limited to the above-described type refrigerator and may include various types of refrigerators such as a top mounting type refrigerator in which a freezing compartment is disposed above a refrigerating compartment, a side by side type refrigerator in which a freezing compartment and a refrigerating compartment are partitioned into left and right sides, and the like.

The door 200 is installed at the cabinet 100 and opens and closes the storage compartments 110 and 120.

In the embodiment, the door 200 will be described as being installed in a form in which a door for opening and closing a freezing compartment and a door for opening and closing a refrigerating compartment are provided and divided as a left door and a right door.

However, the present invention is not limited thereto, and may include refrigerators having various types of doors such as a type in which a door for opening and closing a freezing compartment and a door for opening and closing a refrigerating compartment are installed one by one, a type in which only one of a door for opening and closing a freezing compartment and a door for opening and closing a refrigerating compartment is divided into a left door and a right door, a type in which both a door for opening and closing a freezing compartment and a door for opening and closing a refrigerating compartment are pivotably mounted, a type in which only one of a door for opening and closing a freezing compartment and a door for opening and closing a refrigerating compartment is mounted to be withdrawable forward and rearward, and the like.

In the embodiment, for example, a type in which a door for opening and closing a refrigerating compartment is divided into a left door and a right door will be described.

Also, the door 200, which is at least one of the left door and the right door, may be provided as a type of door including a main door 210 and a sub door 220.

In the above-described type door 200, the main door 210 is pivotably installed at the cabinet 100 and provided to open and close the storage compartment 110 and 120, and an opening is provided inside the main door 210 passing therethrough in anteroposterior directions.

Also, the sub door 220 is pivotably installed at the main door 210 and includes the opening provided at the main door 210.

According to the refrigerator having the above-configured door 200, the storage compartments 110 and 120 inside the refrigerator may be divided into a main storage compartment 110 and a sub storage compartment 120.

The main storage compartment 110 corresponds to a storage space formed in a space inside the cabinet 100 and is opened and closed by the main door 210.

Also, the sub storage compartment 120 corresponds to a storage space formed between the sub door 220 and the main storage compartment 110 in a space including the opening and is opened and closed by the sub door 220.

The support 300 is provided to be changeable in position to an unfolded position unfolded outside the storage compartments 110 and 120 and a folded position folded inside the storage compartments 110 and 120.

The support 300 may be changed in position to the folded position by a pressure applied by a closing operation of the door 200, particularly, of the sub door 220, and may be changed in position to the unfolded position when the application of the pressure is released by an opening operation of the door 200.

For example, the support 300 may be provided to include a vertically flat hexahedral plate and a rotating shaft mounted to laterally protrude from both sides of the plate.

Here, the rotating shaft is provided to be positioned at a position biased toward a rear side of the support 300 when the support 300 is unfolded at the unfolded position.

Since the rotating shaft is combined with the main door 210 to be vertically pivotable while passing through both inner walls of the main door 210, the support 300 provided as described above may be installed at the main door 210 to be erect and positioned in the sub storage compartment 120 at the folded position (refer to FIG. 6) and to be unfolded outside the sub storage compartment 120, in other words, forward from the sub storage compartment 120, at the unfolded position.

That is, the support 300 may be combined with the main door 210 to be vertically pivotable, may pivot upward around the rotating shaft to be erect at the folded position in such a way that the entire support 300 may be positioned in the sub storage compartment 120, and may pivot downward around the rotating shaft to be unfolded forward at the unfolded position in such a way that most of the support 300 is positioned outside the sub storage compartment 120.

In the embodiment, the folded position is defined as a position at which the support 300 is erect in a longitudinal direction parallel to a plane in the longitudinal direction formed by the door 200 and the unfolded position is defined as a position at which the support 300 is unfolded in a lateral direction perpendicular to the plane in the longitudinal direction formed by the door 200.

However, the folded position may be a position at which the support 300 is erect and inclined a certain angle forward in comparison to the plane in the longitudinal direction formed by the door 200 and the unfolded position may include not only a position exactly perpendicular to the plane in the longitudinal direction formed by the door 200 but also a position vertically inclined by a certain degree from the position.

As another example, the support 300 may be provided as a shape in which a shaft hole is concavely formed at one or more side of a vertically flat hexahedral plate.

In this case, at the one or more side of the support 300, the main door 210 may be pivotably combined with the support 300 while a protruding shaft that protrudes from the inner wall of the main door 210 is inserted into the shaft hole.

As another example, the support 300 may be installed at the cabinet 100 and not at the main door 210.

In this case, since the support 300 is pivotably combined with both of the inner walls of the cabinet 100 in which the main storage compartment 110 is formed, the support 300 may be installed at the cabinet 100 to be erect and positioned in the main storage compartment 110 at the folded position and to be unfolded outside the main storage compartment 110 at the unfolded position.

As another example, embodiments of the present invention may include various forms in which the support 300 may be installed at various positions of the refrigerator such as at both the main door 210 and the cabinet 100.

Referring to FIGS. 3 and 4, the position maintainer 400 is provided as a component that restricts a movement of the support 300 to maintain a position of the support 300 changed to the unfolded position or the folded position at a corresponding position.

In the embodiment, the position maintainer 400 will be exemplarily described as being disposed in a space of the main door 210 in which the sub storage compartment 120 is formed and as being positioned at a lower inner wall of the main door 210.

As another example, when the support 300 is installed at the cabinet 100, the position maintainer 400 may be provided to be disposed in a space of the cabinet 100 in which the main storage compartment 110 is formed.

As shown in FIGS. 3 to 5, the position maintainer 400 may be provided in a form including a lateral supporting wall 410 and a longitudinal supporting wall 420.

The lateral supporting wall 410 forms a lateral wall that supports a bottom surface of the support 300 from below to maintain the support 300 laterally unfolded at the unfolded position.

Preferably, the lateral supporting wall 410 is provided to be positioned relatively more toward a front side than the rotating shaft that is a pivoting center of the support 300.

Also, the longitudinal supporting wall 420 forms a longitudinal wall that supports the bottom surface of the support 300 from the front to maintain the support 300 that is longitudinally erect at the folded position.

For example, the longitudinal supporting wall 420 may be formed in such a way that a longitudinally erect wall extends along the support 300 widthwise, and the lateral supporting wall 410 may be formed in such a way that a lateral wall with a width corresponding to a width of the longitudinal supporting wall 420 is provided on a top end of the longitudinal supporting wall 420 that is erect as described above to be connected to the longitudinal supporting wall 420 while forming a T shape.

Additionally, the position maintainer 400 may further include a supporting rib 430 in addition to the lateral supporting wall 410 and the longitudinal supporting wall 420.

The supporting rib 430 supports a top surface of the support 300 from above behind the longitudinal supporting wall 420 to maintain a laterally unfolded state of the support 300 at the unfolded position.

According to the embodiment, the supporting rib 430 may be provided in an upside-down L shape, that is, a "T" shape, in which a supporting protrusion 433 protrudes laterally forward from a top end of a longitudinal wall 431 that is erect and spaced a certain interval apart from the longitudinal supporting wall 420.

The supporting rib 430 is provided in such a way that the laterally unfolded top surface of the support 300 interferes with the supporting protrusion 433 of the supporting rib 430 at the unfolded position and a movement of the support 300 that interferes with the supporting protrusion 433 of the supporting rib 430 is restricted not to pivot further downward from a position of the supporting protrusion 433 to maintain the position of the support 300 at the unfolded position.

Additionally, a mounting groove 310 for mounting the supporting protrusion 433 of the supporting rib 430 may be formed in one area of the support 300 in contact with the supporting protrusion 433 of the supporting rib 430.

The mounting groove 310 may be provided at a depth at which a contact portion between the support 300 and the supporting protrusion 433 of the supporting rib 430 are in the same plane.

Accordingly, when the support 300 is unfolded at the unfolded position, the top surface of the support 300 and the supporting rib 430 may form the same plane and be smoothly connected in such a way that external qualities of an installation site of the support 300 may be improved and a holding area provided by the support 300 may be enlarged.

Preferably, the supporting rib 430 is provided to be positioned relatively more toward a back side than the rotating shaft that is the pivoting center of the support 300.

That is, based on the rotating shaft of the support 300, the lateral supporting wall 410 may be positioned toward the front side and the supporting rib 30 may be positioned toward the back side.

Observing a supporting state of the support 300 at the unfolded position in more detail, the support 300 pivoted toward a position corresponding to the unfolded position is restricted not to further pivot and is mounted at the unfolded position while the bottom surface thereof interferes with the lateral supporting wall 410 to be supported by the lateral supporting wall 410 and the top surface thereof interferes with the supporting protrusion 433 of the supporting rib 430 to be supported by the supporting rib 430.

Here, since a supporting structure in which the lateral supporting wall 410 supports the bottom surface of the support 300 in front of the rotating shaft and the supporting rib 430 supports the top surface of the support 300 behind the rotating shaft is formed, the support 300 may be supported without being tilted by the position maintainer 400 and may be stably mounted at the unfolded position.

Referring to FIGS. 6 and 7, the support 300 that has pivoted upward from the unfolded position may be supported at the bottom surface thereof from the front by the longitudinal supporting wall 420 and may remain in a state of being longitudinally erect at the folded position.

Here, the longitudinal supporting wall 420 may come into indirect contact with the support 300 with an elastic pressurizer 440, which will be described below, as a medium and may support the support 300 from the front.

According to the embodiment, the support 300 that is longitudinally erect at the folded position may be erect and be tilted outward from the storage compartments 110 and 120 (refer to FIG. 1) to receive a force for being laterally unfolded at the folded position, that is, for being pivoted downward.

That is, the support 300 according the embodiment is not vertically erect and may tilt a certain angle forward from a vertical direction, that is, may be erected in such a way that the top surface of the support 300 tilts forward in comparison to the rotating shaft that is the pivoting center of the support 300.

When the support 300 is erect and tilts as described above, the support 300 may pivot downward due to the support's 300 own weight when an application of pressure to the support 300 is released.

That is, the support 300 that is erect and tilted as described above may pivot downward due to the support's 300 own weight and be changed in position to the folded position when the application of pressure to the support 300 is released by the opening operation of the door 200.

According to the embodiment, when a lateral unfolded angle of the support 300 at the unfolded position is 0°, a tilting range of the support 300 that is longitudinally erect at the folded position may be in a range of 75° or more and less than 90° as shown in FIG. 8.

When the tilt of the support 300 that is longitudinally erect at the folded position is less than 75°, the support 300 is positioned at a position at which the top end of the support 300 protrudes excessively outward from the storage compartments 110 and 120 even in a state in which the support 300 is folded. Accordingly, when the door 200 is closed, the support 300 collides with the door 200 in such a way that the support 300 or the door 200 may be damaged or the door 200 may not be properly closed due to interference between the support 300 and the door 200.

To prevent such problems, a size of the support may be reduced so as not to allow the top end of the support 300 to protrude outward from the storage compartments 110 and 120 when the support 300 is longitudinally erect. However, in this case, an item holding space provided by the support 300 is unnecessarily reduced.

When the tilt of the support 300 that is longitudinally erect at the folded position is more than 90°, it is difficult for a force of the support's 300 own weight to act on a front side of the support 300. Accordingly, downward pivoting of the support 300 may be delayed or inadequately performed.

In comparison to this, when the tilt of the support 300 that is longitudinally erect at the folded position is in the range of 75° or more and less than 90°, not only is there no possibility of collision between the door 200 and the support 300 or problem in closing the door when the door 200 is closed, the downward pivot, that is, an unfolding operation, of the support 300 due to the support's 300 own weight is also smoothly performed.

Additionally, the position maintainer 400 according to the embodiment may further include the elastic pressurizer 440.

The elastic pressurizer 440 is configured to provide an elastic force applied in a direction that allows the support 300 that is longitudinally erect to tilt outward from the storage compartments 110 and 120.

In the embodiment, the elastic pressurizer 440 is exemplarily described as being formed of a rubber material having an elastic force.

However, the present invention is not limited thereto, and various shaped members formed of a soft material having an elastic force may be used as the elastic pressurizer 440 according to embodiments of the present invention.

The elastic pressurizer 440 comes into direct contact with the support 300 that is erect and pivots toward the folded position to restrict the movement of the support 300 not to further pivot beyond the folded position.

Since the elastic pressurizer 440 is formed of a soft material having an elastic force, the elastic pressurizer 440 may be pushed by the support 300 that pivots toward the folded position and may buffer a shock caused by a collision with the support 300.

Also, the elastic pressurizer 440 remains in a state of being pressed by the support 300 when a state in which the support 300 is erect and fixed at the folded position is maintained, and is released from the state of being pressed and pushes the support 300 forward when the application of pressure to the support 300 is released by the opening operation of the door 200.

Accordingly, the support 300 may be pivoted downward due to a force obtained by adding the support's 300 own weight and the elastic force of the elastic pressurizer 440 to be changed in position to the unfolded position.

When the pivoting of the support 300 that is longitudinally erect is performed, a moment applied to the support 300 to allow the support 300 to pivot is relatively weaker when a position thereof is closer to the folded position and is relatively stronger when the position is closer to the unfolded position of the support 300.

Accordingly, the moment is relatively weakly applied at a time when the support 300 starts pivoting at the position close to the folded position, that is, at an initial stage of the pivoting of the support 300. Due to this, a phenomenon in which the pivoting of the support 300 is inadequately performed may occur.

According to the embodiment, since an elastic force applied by the elastic pressurizer 440 is added and the support 300 is pushed with a stronger force at the initial stage of the pivoting of the support 300 in which the moment is relatively weakly applied, the downward pivoting of the support 300 for changing the position of the support 300 to the unfolded position may be smoothly performed.

According to the embodiment, the elastic pressurizer 440 is installed at the longitudinal supporting wall 420 to be positioned between the support 300 that is longitudinally erect and the longitudinal supporting wall 420.

In other words, the elastic pressurizer 440 is installed on an inner surface of the longitudinal supporting wall 420 that faces the supporting rib 430 to be hidden between the longitudinal supporting wall 420 and the supporting rib 430.

Accordingly, since a protruding structure such as the elastic pressurizer 440 is not visible from the outside, an external aesthetic of the installation site of the support 300 may be further improved.

In the embodiment, the elastic pressurizer 440 is exemplarily described as being installed at the longitudinal supporting wall 420 to be positioned between the support 300 that is longitudinally erect and the longitudinal supporting wall 420. However, the present invention is not limited thereto.

Referring to FIG. 9, an elastic pressurizer 440*a* may be provided to be installed at the bottom surface of the support 300.

The elastic pressurizer 440*a* provided as described above is provided to be positioned at a position at which a front side thereof is hidden by the longitudinal supporting wall 420, a rear side thereof is hidden by the supporting rib 430, and a top side thereof is hidden, that is, a position at which the front side, the rear side, and the top side of the elastic pressurizer 440*a* are surrounded by the longitudinal supporting wall 420, the supporting rib 430, and the support 300 when the support 300 is laterally unfolded at the folded position.

Since the elastic pressurizer 440*a* provided as described above is also not visible from the outside, an effect of further improving the external aesthetic of the installation site of the support 300 may be provided.

When the elastic pressurizer 440*a* is combined with and installed at the bottom surface of the support 300 as shown in FIG. 10 and the support 300 pivots toward the folded position to be erect, the elastic pressurizer 440*a* provided as described above may come into contact with the longitudinal supporting wall 420.

The elastic pressurizer 440*a* in contact with the longitudinal supporting wall 420 as described above is pressed between the support 300 and the longitudinal supporting wall 420 and accumulates an elastic force while the support 300 is continuously pivoted toward the folded position.

Also, when the pivoting of the support 300 is performed so as not to press the elastic pressurizer 440*a* any more, the support 300 does not pivot beyond the folded position and the movement thereof is restricted.

Also, when the application of pressure to the support 300 is released by the opening operation of the door 200, a pressed state of the elastic pressurizer 440*a* is released and the elastic force of the elastic pressurizer 440*a* is applied to the support 300 to push the support 300 toward the front side.

In addition, the present invention may include various modified embodiments related to an installation position of the elastic pressurizer 440*a*. For example, the elastic pressurizer 440*a* may be installed at a variety of positions not visible from the outside or may be installed at a position visible from the outside when necessary for an increased function.

Figure 11:
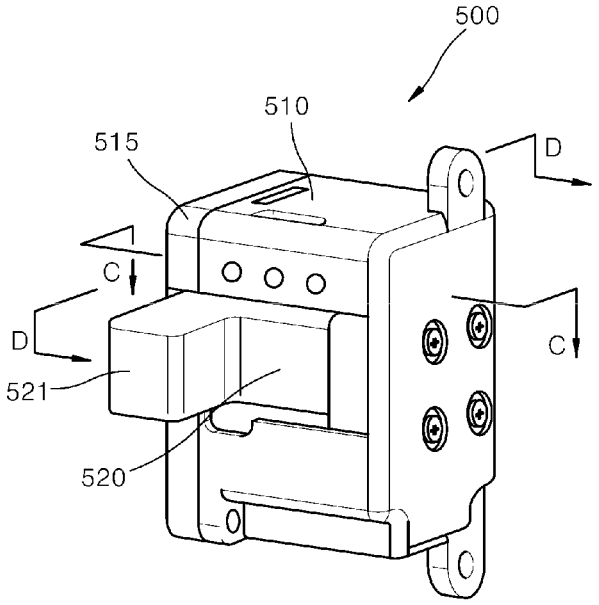
FIG. 11 is a perspective view illustrating a folding guide device shown in FIG. 4.
Figure 12:
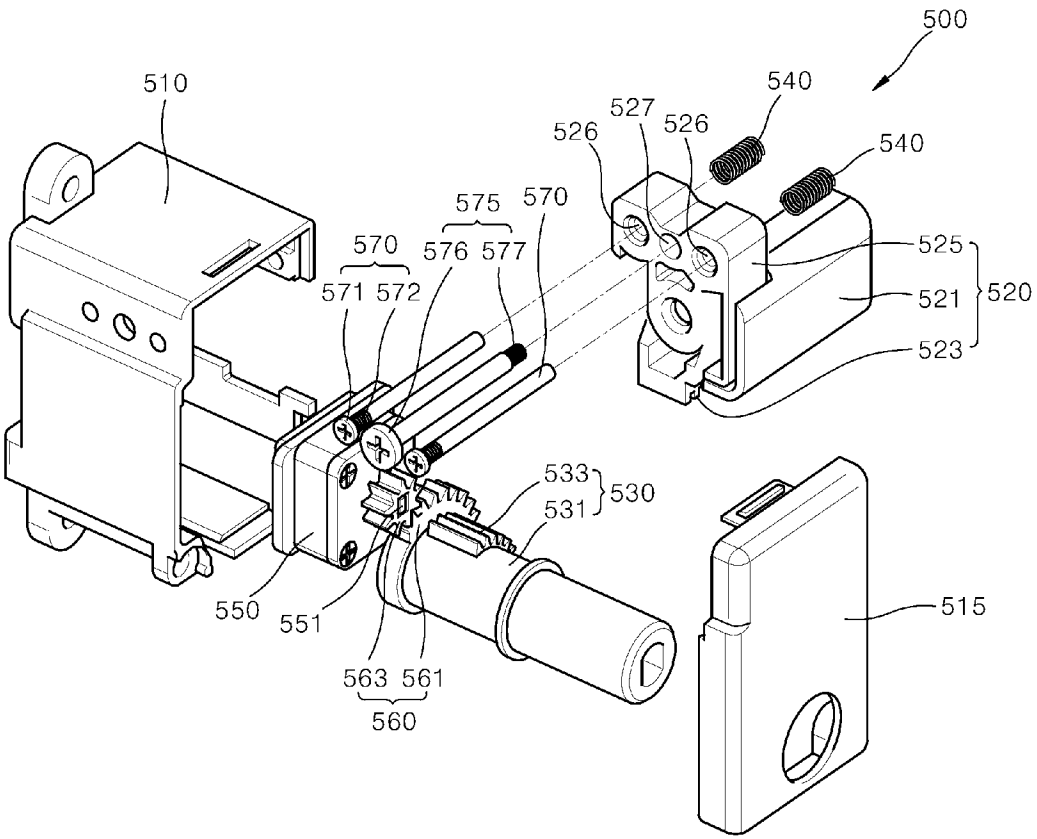
FIG. 12 is an exploded perspective view illustrating a disassembled state of the folding guide device shown in FIG. 11.
Figure 13:
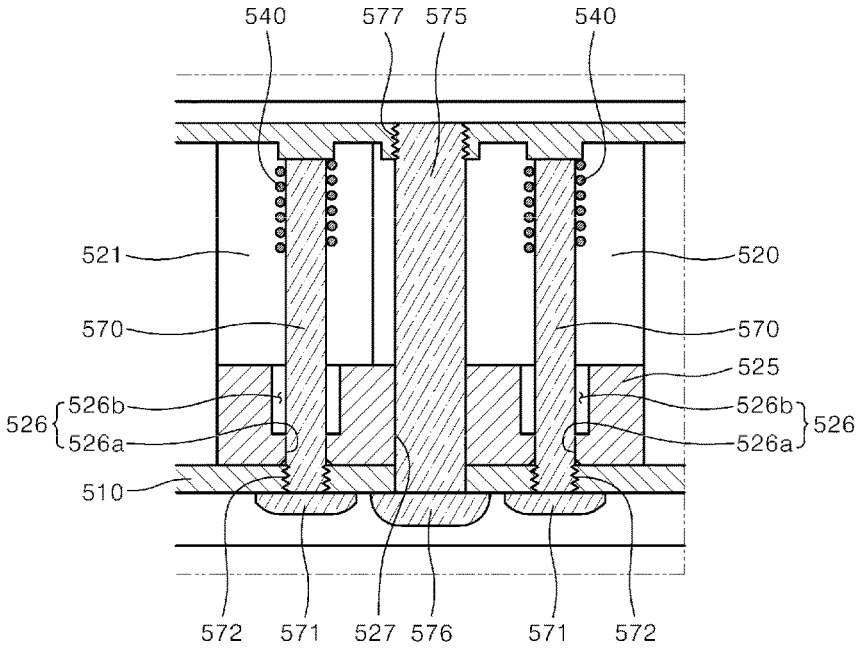
FIG. 13 is a cross-sectional view illustrating a part taken along line C-C of FIG. 11.
Figure 14:
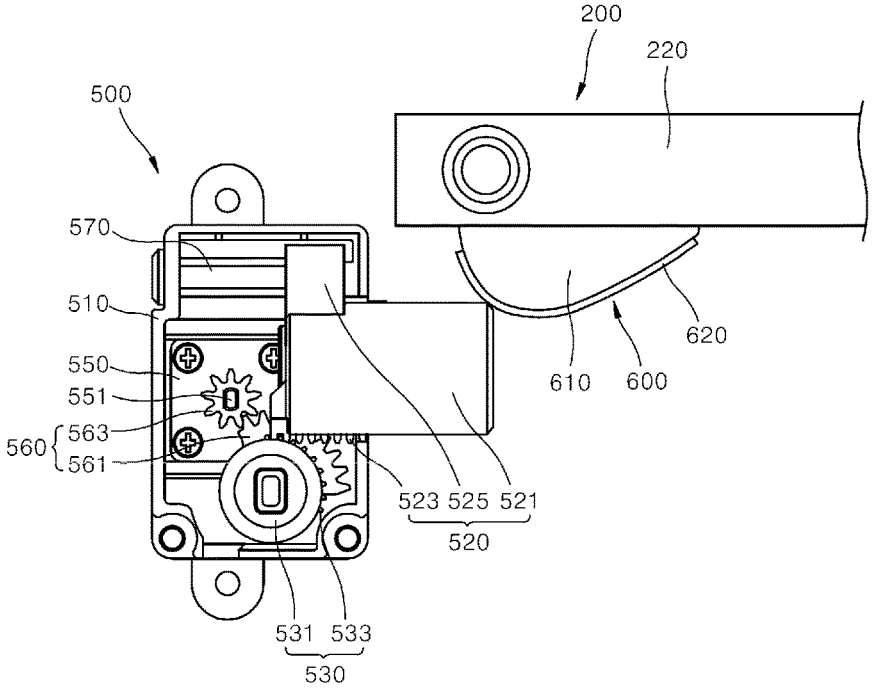
FIG. 14 is a cross-sectional view illustrating a part taken along line D-D of FIG. 11.
Figure 15:
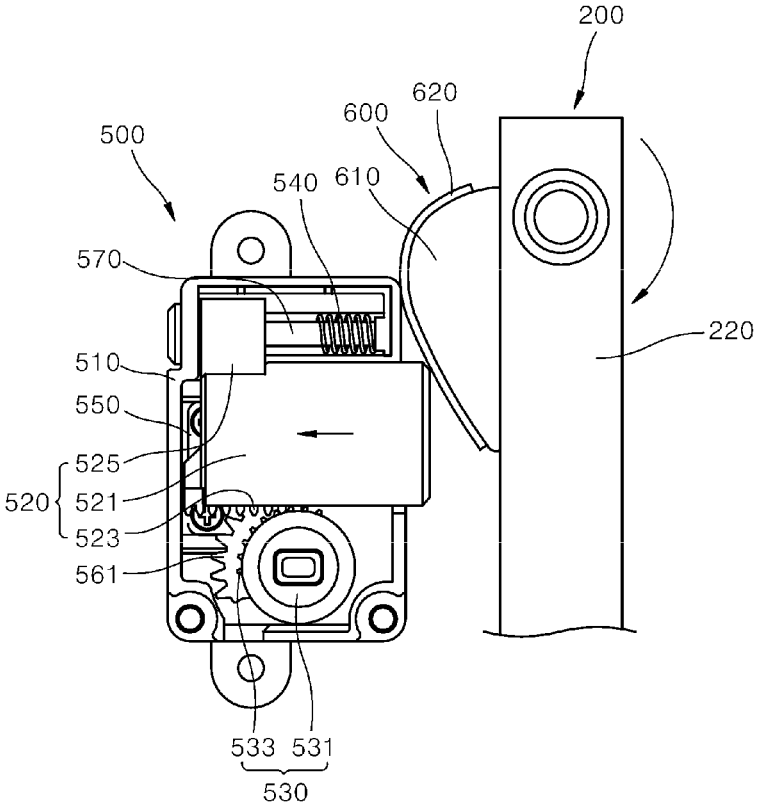
FIG. 15 is a view illustrating a depressed position movement state of a slider shown in FIG. 14.

FIG. 11 is a perspective view illustrating the folding guide device 500 shown in FIG. 4, FIG. 12 is an exploded perspective view illustrating an exploded state of the folding guide device 500 shown in FIG. 11, FIG. 13 is a cross-sectional view illustrating a part taken along line C-C of FIG. 11, FIG. 14 is a cross-sectional view illustrating a part taken along line D-D of FIG. 11, and FIG. 15 is a view illustrating a depressed position movement state of a slider shown in FIG. 14.

Hereinafter, referring to FIGS. 2 to 15, a structure and an operation of the folding guide device 500 will be described.

Referring to FIGS. 2 and 11, the folding guide device 500 is provided to operate in conjunction with the closing operation of the door 200 and to perform an operation of applying a pressure to the support 300 to change a position of the support 300 positioned at the unfolded position to the folded position.

As shown in FIGS. 11 and 12, the folding guide device 500 includes a case 510 and 515, a slider 520, a conversion outputter 530, and an elastic supporter 540.

The case 510 and 515 is provided to form an exterior of the folding guide device 500 and to accommodate the conversion outputter 530 and the elastic supporter 540. Also, the slider 520 is movably accommodated in the case 510 and 515.

According to the embodiment, the case 510 and 515 is provided to be separated into a first case 510 and a second case 515.

The first case 510 is provided in a shape in which an accommodating space for accommodating the slider 520, the conversion outputter 530, and the elastic supporter 540 is formed and which has one open side.

In the first case 510, the slider 520 is slidably mounted, components of the conversion outputter 530 are rotatably mounted, and one end of the elastic supporter 540 is mounted to be supported by an inner wall of the first case 510.

Additionally, an opening that provides a path which allows a part of the slider 520 movably accommodated to protrude outside of the case 510 and 515 may be formed at a front side of the first case 510 to pass therethrough.

The opening may not only be formed at the front side of the first case 510 but may also be formed by combining a groove formed at the second case 515 with a groove formed at the front of the first case 510.

Also, the second case 515 is combined with the one open side of the first case 510 to be assembled with the first case 510 as a single case.

When the case of the folding guide device 500 is integrally formed as a single member, it is difficult to assemble complicated components in an internal space thereof. Accordingly, the separated first and second cases 510 and 515 may be combined with each other to be assembled as the case 510 and 515.

The slider 520 is movably accommodated in the case 510 and 515 while being mounted in the case 510 and 515 to be slidable forward and rearward through a combination with guide pins 570 and 575, which will be described below, as a medium.

The slider 520 is provided to be slidably movable to a protruding position and a depressed position and is pressurized by the door 200 that closes the storage compartments 110 and 120 to be moved to the depressed position.

In the embodiment, the folding guide device 500 and the slider 520 are exemplarily described as being provided therein are installed at the main door 210 and the slider 520 is described as being moved to the depressed position by the sub door 220 that closes the sub storage compartment 120. However, the present invention is not limited thereto.

That is, the present invention may include various modified embodiments related to an installation position of the folding guide device 500 in which, when the support 300 (refer to FIG. 2) is installed at the cabinet 100 (refer to FIG. 2) and not in the main door 210, the folding guide device 500 may be installed at the cabinet 100 to be positioned beside the support 300. When the support 300 is installed at a cabinet that forms a cooking chamber of another apparatus that is not a refrigerator, for example, an electric range or an oven, the folding guide device 500 may be installed the cabinet of the corresponding apparatus at which the support 300 is installed.

Meanwhile, a protrusion 521 that protrudes past a front surface of the case 510 and 515 is provided at a front side of the slider 520.

The protrusion 521 is a part that protrudes forward from the case 510 and 515 when the slider 520 is moved to the protruding position, and corresponds to a part that directly receives a pressure applied by the closing operation of the door 200.

In the embodiment, a state in which the protrusion 521 is completely protruded from the case 510 and 515 is defined as the protruding position and a state in which most of an area of the protrusion 521 is inserted into the case 510 and 515 is defined as the depressed position.

The slider 520 may input a linear force to the conversion outputter 530 while being moved from the protruding position to the depressed position, and may be moved from the depressed position to the protruding position by a linear force input through the conversion outputter 530. A detailed description thereof will be described below.

The conversion outputter 530 is provided to be accommodated in the case 510 and to connect the slider 520 with the support 300.

The conversion outputter 530 outputs the linear force input by the slider 520 that moves to the depressed position as a rotational force in one direction to change the position of the support 300 to the folded position.

Also, the conversion outputter 530 may output a rotational force in another direction input by the support 300 changed in position to the unfolded position as a linear force for returning the slider 520 to the protruding position.

According to the embodiment, a rack 523 with sawteeth formed downward is provided at a bottom of the slider 520, the conversion outputter 530 is provided to include a rotating gear 531 with a pinion 533 engaged with the rack 523 and provided on an outer circumferential surface thereof, and the rotating gear 531 is rotatably installed at the case 510 and 515 to be rotatable in one direction or the other direction that is a reverse direction thereof.

Here, the rack 523 may be formed with an adequate length in consideration of a movement distance of the slider 520 and the engagement with the pinion 533.

Also, the pinion 533 may be provided to be formed throughout an overall outer circumferential surface of the rotating gear 531 or may be formed only at a part of the outer circumferential surface of the rotating gear 531, that is, within a range in consideration of an adequate area in which the engagement with the rack 523 is performed.

When the pinion 533 is provided to be formed throughout the entire outer circumferential surface of the rotating gear 531, the engagement between the rack 523 and the pinion 533 is performable at an adequate position at any position of the rotating gear 531. Accordingly, the rotating gear 531 may be easily assembled.

When the pinion 533 is formed at a part of the outer circumferential surface of the rotating gear 531, a size of the case 510 and 515 may be reduced by as much as a part at which the pinion is not formed. Accordingly, the folding guide device 500 may be provided in a more compact size.

A connection between the slider 520 and the conversion outputter 530 is performed by the engagement between the rack 523 of the slider 520 and the pinion 533 of the rotating gear 531.

Due to the above-described connection between the slider 520 and the conversion outputter 530, the linear force input by the slider 520 that moves to the depressed position is transferred to the pinion 533 by the rack 523 engaged with the pinion 533, and the linear force transferred as described above is transferred to the rotating gear 531 through the pinion 533 that rotates and is engaged with the rack 523.

Accordingly, the rotating gear 531 rotates in one direction and the rotating gear 531 that rotates in one direction as described above may output the linear force input by the slider 520 that moves to the depressed position as a rotational force in one direction.

According to the embodiment, the rotating gear 531 is inserted into a shaft hole formed to pass through the case 510 and 515, in more detail, through the second case 515, to be rotatably installed at the case 510 and 515, and an end of the rotating gear 531 is exposed outside the second case 515.

That is, the slider 520 is provided to be protrudable forward from the case 510 and 515, and the rotating gear 531 is provided to allow the end thereof to be exposed toward one side of the case 510 and 515 in a lateral direction.

Also, as shown in FIGS. 3 and 4, the folding guide device 500 is installed to be built into a sidewall of the main door 210 to be positioned beside the support 300 when the slider 520 is exposed forward from the main door 210 that faces the sub door 220 and the end of the rotating gear 531 is exposed outward from the inner wall of the main door 210 that faces the support 300.

The rotating gear 531 exposed outward from the inner wall of the main door 210 may be connected to the rotating shaft that protrudes from one side of the support 300 that faces the rotating gear 531.

Here, the rotating shaft of the support 300 and the rotating gear 531 may be connected to be integrally rotated.

For example, an end of the rotating shaft connected to the rotating gear 531 does not have a cylindrical shape and is formed in a shape in which at least one side of a circumferential portion of a cylinder is incised by a plane, a connection groove concavely formed corresponding to a shape of the end of the rotating shaft is formed inside the end of the rotating gear 531, and a connection between the rotating shaft and the rotating gear 531 may be performed while the end of the rotating shaft is inserted into the connection groove formed as described above.

However, the present invention is not limited thereto and may include various shapes of connection structures such as a key and a key groove capable of rotating the rotating shaft and the rotating gear 531 while being integrated therewith.

Due to the above-described connection structure, the rotating gear 531 connected to the support 300 transfers a rotational force to the support 300 in a direction which changes the position of the support 300 from the unfolded position to the folded position when rotated in one direction, that is, a direction which allows the support 300 to pivot.

The above-described rotating gear 531 may be rotated in the other direction by the support 300 being changed in position in a direction of changing from the folded position to the unfolded position, that is, pivoting downward.

Additionally, as shown in FIGS. 11 and 12, the folding guide device 500 according to the embodiment may further include a damper 550 that provides a damping force for damping the rotational force in the other direction input into the conversion outputter 530 and a connector 560 that transfers the damping force provided by the damper 550 to the conversion outputter 530.

According to the embodiment, the damper 550 is provided in a form capable of selectively applying resistance to only the rotation of the rotating gear 531 in the other direction.

For example, the damper 550 may be provided in a form in which a case that forms an exterior of the damper 550 is filled with a working fluid having high viscosity, a plurality of rotating members are rotatably installed in the case filled with the working fluid as described above, and a shaft 551 that is combined with the rotating members to be rotated with the rotating members and protrudes outward from the case is included.

According to the damper 550, the rotating members are formed to have a shape that receives a relatively great resistance from the working fluid when rotating in the other direction according to the shaft 551, and then the rotation of the shaft 551 in the other direction is performed at a lower speed than the rotation in one direction even when the same rotational force is input to the shaft 551. Accordingly, the shaft 551 of the damper 550 operates as resistance against the rotation of the rotating gear 531 in the other direction.

A connection between the damper 550 and the conversion outputter 530 may be performed by the connector 560.

In the embodiment, the connector 560 is exemplarily described as including a damper driving gear 561 provided to be integrally rotated with the rotating gear 531, a driven gear 563 provided to rotate on the same axis as the shaft 551 and be engaged with the damper driving gear 561.

Here, the damper driving gear 561 may be provided to be a separate gear from the rotating gear 531 that is combined and assembled with the rotating gear 531 or may be provided to be integrated with the rotating gear 531.

When the damper driving gear 561 and the rotating gear 531 are provided to be separate gears, each of the damper driving gear 561 and the rotating gear 531 may be easily manufactured through injection-molding. When the damper driving gear 561 and the rotating gear 531 are integrated, the number of assembling processes necessary for assembling the folding guide device 500 may be reduced.

The damper driving gear 561 transfers a rotational force to the driven gear 563 while being integrally rotated with the rotating gear 531, and the driven gear 563 transfers the rotational force to the shaft 551 while being rotated together with the damper driving gear 561.

The rotating gear 531 is rotated in the other direction, and the rotation of the rotating gear 531 in the other direction receives resistance by the shaft 551 being connected to the rotating gear 531 through the connector 560 as a medium, and accordingly a rotation speed of the rotating gear 531 is reduced.

The above-describe rotating gear 531 with a decreased rotation speed acts as resistance that interferes with the downward pivoting of the support 300 (refer to FIG. 7), and accordingly the support 300 may have a reduced downward pivoting speed and be smoothly unfolded while pivoting toward the unfolded position.

As another example, the connector 560 is not provided between the shaft 551 and the rotating gear 531, and a connection between the rotating gear 531 and the damper 550 may be performed while the shaft 551 is directly connected to the rotating gear 531.

As another example, a damper provided as a hydraulic damper providing a linear damping force directly restricts a linear movement of the slider 520 that moves in a protruding direction, thereby reducing the rotational force of the rotating gear 531 and the support 300.

Meanwhile, as shown in FIGS. 11 to 13, the folding guide device 500 according to the embodiment may further include the guide pins 570 and 575 and a combiner 525.

The guide pins 570 and 575 are installed at the case 510 and 515 and combined with the slider 520. The guide pins 570 and 575 are slidably combined with the slider 520 and guide a movement path of the slider 520 that moves between the protruding position and the depressed position.

Also, the combiner 525 is provided to combine the slider with the guide pins 570 and 575 to be slidably movable and protrudes from a top of the slider 520.

The guide pins 570 and 575 include spring mounting pins 570 on which coil springs of the elastic supporters 540, which will be described below, are put and a sliding pin 575 with which the combiner 525 is slidably combined.

Each of the spring mounting pins 570 does not have a simple pin shape and may include a head 571 provided at one end of the pin and a screw thread 572 provided at an outer circumferential surface of the pin to be adjacent to the head 571.

A line-shaped or cross-shaped groove may be formed at the head 571, and the spring mounting pin 570 may be fastened to a fastening hole formed at the case 510 and 515 by being screw coupled and combined with the case 510 and 515.

The sliding pin 575 includes a head 576 and a screw thread 577 like the spring mounting pins 570. The head 571 may be formed at one end of the pin and the screw thread 577 may be formed at an outer circumferential portion of the other end opposite the one end.

Also, the combiner 525 includes first through holes 526 formed at and passing through the combiner 525 to allow the spring mounting pins 570 to pass through the combiner 525 and a second through hole 527 formed at and passing through the combiner 525 to allow the sliding pin 575 to pass through the combiner 525.

According to the embodiment, the guide pins 570 and 575 include a pair of such spring mounting pins 570 spaced a certain interval apart, and the sliding pin 575 is disposed to be positioned between the pair of spring mounting pins 570.

Also, the combiner 525 includes a pair of such first through holes 526 spaced an interval corresponding to the interval between the pair of spring mounting pins 570 apart, and the second through hole 527 is disposed between the pair of first through holes 526.

A slidable combination between the guide pins 570 and 575 and the combiner 525 may be performed through an insertion-combination between the spring mounting pins 570 and the combiner 525 in which the pair of spring mounting pins 570 pass through the pair of first through holes 526 and an insertion-combination between the sliding pin 575 and the combiner 525 in which the sliding pin 575 passes through the second through hole 527.

That is, the slidable combination between the guide pins 570 and 575 and the combiner 525 may be performed when the combiner 525 is slidably suspended on the guide pins 570 and 575, and the slider 520 may be slidably combined with the guide pins 570 and 575 through the above-described combination between the guide pins 570 and 575 and the combiner 525.

Meanwhile, each of the first through holes 526 may be divided into a through hole 526*a* and an extension hole 526*b*.

The through hole 526*a* is formed to have an inner diameter through which the spring mounting pin 570 is passable, and the extension hole 526*b* is formed to have an inner diameter larger than that of the through hole 526*a* to allow the coil spring of the elastic supporter 540 put around the spring mounting pin 570, which will be describe below, to pass therethrough.

Compared to this, the second through hole 527 is formed to have entirely the same inner diameter corresponding to an outer diameter of the sliding pin 575. Accordingly, the sliding pin 575 is slidably combined with the combiner 525 while being in close contact with an inner circumferential surface of the combiner 525 at which the second through hole 527 is formed.

When the coil spring is inserted into the extension hole 526*b* and in contact with the combiner 525 and is compressed or elastically restored and generates a force that shakes the combiner 525, a movement occurs throughout the slider 520 including the combiner 525 in such a way that not only forward and rearward movements of the slider 520 may not be smoothly performed but also a noise may occur during the movements of the slider 520.

Even though the coil spring generates the force that shakes the combiner 525 when compressed or elastically restored, the combiner 525 may be combined with the guide pins 570 and 575 while being in sufficiently close contact therewith so as not to allow the combiner 525 to be shaken by the force to suppress the occurrence of movement of the combiner 525.

Considering a combination structure between the spring mounting pin 570 and the combiner 525, a contact area between the inner circumferential surface of the combiner 525 at which the first through hole 526 is formed and an outer circumferential surface of the spring mounting pin 570 is restricted to an area at which the through hole 526*a* is formed.

That is, since the inner diameter of the extension hole 525*b* formed to support the coil spring is larger than the outer diameter of the spring mounting pin 570, the outer circumferential surface of the spring mounting pin 570 may not come into contact with the inner circumferential surface of the combiner 525 in an area at which the extension hole 526*b* is formed.

Accordingly, it is difficult to sufficiently obtain the contact area between the combiner 525 and the guide pins 570 and 575 for stably combining the combiner 525 with the guide pins 570 and 575 only through the combination between the spring mounting pin 570 and the combiner 525.

To overcome this, in the embodiment, the sliding pin 575 is installed between the pair of spring mounting pins 570 spaced the certain interval apart so that the sliding pin 575 is combined with the combiner 525 while being in contact with the inner circumferential surface of the combiner 525 at which the second through hole 527 is formed.

Here, the second through hole 527 may be formed to have an inner diameter to identical to the outer diameter of the sliding pin 575 to allow the overall inner circumferential surface of the combiner 525 at which the second through hole 527 is formed to come into contact with the sliding pin 575.

Considering a combination structure between the sliding pin 575 and the combiner 525 at which the second through hole 527 is formed, the contact area between the outer circumferential surface of the sliding pin 575 and the inner circumferential surface of the combiner 525 at which the second through hole 527 is formed is expanded to be as large as the entire area at which the second through hole 527 is formed, that is, an area including the through hole 526*a* and the extension hole 526*b* of the first through hole 526.

The combination structure between the combiner 525 and the sliding pin 575 may provide a supporting force so as not to allow the combiner 525 to be shaken even though the coil spring generates a force that shakes the combiner 525 when compressed or elastically restored.

Particularly, since the combination structure between the combiner 525 and the sliding pin 575 is provided between the pair of spring mounting pins 570, that is, in a center of the guide pins 570 and 575, it is possible to effectively suppress shaking that may occur at both sides on which the spring mounting pins 570 are mounted and to stably support the combiner 525.

Meanwhile, in comparison to the inner diameter of the second through hole 527 formed to be identical to the outer diameter of the sliding pin 575, the first through hole 526 may be configured to form the inner diameter of the through hole 526*a* to be larger than the outer diameter of the spring mounting pin 570.

During a process of assembling the guide pins 570 and 575 with the combiner 525, it is difficult to manage all tolerances of the spring mounting pins 570, the sliding pin 575, the first through hole 526, and the second through hole 527.

Accordingly, in the embodiment, the inner diameter of the second through hole 527 is formed to be identical to the outer diameter of the sliding pin 575 by managing only a tolerance between the sliding pin 575 and the second through hole 527 to prevent a movement of the slider 520 and the tolerances of the spring mounting pins 570 and the first through holes 526 may be managed to allow a certain amount of error.

Accordingly, since it is possible to offset the tolerances that occur during a process of processing and assembling the spring mounting pins 570 and the first through hole 526 when the first through hole 526 is formed to allow the inner diameter of the through hole 526*a* to be larger than the outer diameter of the spring mounting pin 570, tolerance management may be more easily performed.

Meanwhile, the elastic supporter 540 is configured to provide an elastic force applied in a direction that blocks a movement of the slider 520 that is moved to the protruding position.

The elastic supporter 540 may reduce a movement speed of the slider 520 by providing an elastic force applied in a direction that blocks a movement of the combiner 525 moved with the slider 520 moved to the protruding position.

According to the embodiment, the elastic supporter 540 may include a coil spring.

The coil spring included in the elastic supporter 540 is provided to be put around the spring mounting pin 570 to be positioned on a movement path of the combiner 525 and to be compressible by the combiner 525 along a movement direction of the combiner 525.

The coil spring is formed to have a length extending along a longitudinal direction of the spring mounting pin 570, is provided to be elastically compressible along the longitudinal direction, and is installed to be positioned between a wall surface of the case 510 and 515, in more detail, a wall surface of the first case 510 positioned adjacent to the slider 520 moved to the protruding position and the combiner 525.

Preferably, the coil spring is installed while one longitudinal end thereof is fixed to the wall surface of the first case 510.

Also, the other end of the coil spring installed as described above comes into contact with the combiner 525 of the slider 520 moved to the protruding position.

Here, the other end of the coil spring comes into contact with a step formed between the extension hole 526*b* and the through hole 526*a* when inserted into the extension hole 526*b* of the first through hole 526, and accordingly, a contact between the coil spring and the combiner 525 is performed.

The above-described contact between the coil spring and the combiner 525 is performed after a certain distance of movement of the slider 520 toward the protruding position is performed.

When the slider 520 continues the movement to the protruding position while the contact between the coil spring and the combiner 525 is performed as described above, the coil spring interferes with the combiner 525. Accordingly, as the coil spring is elastically compressed, the coil spring applies the elastic force to the combiner 525 in the direction that blocks the movement of the slider 520.

The elastic supporter 540 including the coil spring provided to operate as described above applies the elastic force to the slider 520 in the direction that blocks the movement of the slider 520 after the slider 520 moves the certain distance toward the protruding position.

The elastic force applied to the slider 520 as described above operates as resistance that reduces the rotational force of the rotating gear 531, which is engaged with the slider 520, in the other direction and finally operates as resistance that reduces the downward pivoting speed of the support 300 (refer to FIG. 6) that pivots with the rotating gear 531.

That is, during a downward pivoting process of the support 300 performed to change a position thereof from the folded position to the unfolded position, the damping force of the damper 550 and the elastic force of the elastic supporter 540 operate as resistances that reduce the pivoting speed of the support 300, and accordingly the support 300 may have a reduced pivoting speed and may be smoothly unfolded.

Meanwhile, the above-described operation of the elastic supporter 540 may be performed on the slider 520 after the slider 520 moves to be closer to the protruding position than the depressed position.

When pivoting of the support 300 that is longitudinally erect is performed, a moment applied to the support 300 in a direction that allows the support 300 to pivot downward is relatively weaker when a position thereof is closer to the folded position and is relatively stronger when the position is closer to the unfolded position of the support 300.

Accordingly, a moment stronger than necessary may be applied to the support 300 at a position at which the support 300 approximately arrives at the unfolded position, and due thereto a vertically shaking movement may occur after the support 300 is completely unfolded.

The occurrence of such a phenomenon may be prevented by increasing the damping force of the damper 550 that generates resistance interfering with the downward pivoting of the support 300 (refer to FIG. 7). However, in this case, due to properties of the damper 550 that generates the damping force throughout the pivoting process of the support 300, a phenomenon in which the damping force becomes greater than the moment applied at an initial stage at which the support 300 that is longitudinally erect starts pivoting may occur and the downward pivoting of the support 300 may be not properly performed.

To overcome this, in the embodiment, the damper provides a damping force as strong as a level of force that allows the downward pivoting of the support 300 to be smoothly performed even at the initial stage of the pivoting of the support 300 at which the moment is weak, and a force obtained by adding the damping force of the damper 550 and the elastic force of the elastic supporter 540 operates as a force which reduces the rotational force of the support 300 at a later stage of the pivoting of the support 300 at which the moment is relatively strong.

Then, the downward pivoting of the support 300 at the initial stage may be smoothly performed, the pivoting speed of the support 300 may be reduced to smoothly unfold the support 300, and it is possible to effectively suppress the occurrence of the shaking movement of the support 300 during or after the unfolding of the support 300.

Meanwhile, referring to FIG. 14, the refrigerator according to the embodiment may further include a pressurizing protrusion 600.

The pressurizing protrusion 600 is provided to protrude from a rear surface of the door 200 and pressurizes the slider 520 positioned at the protruding portion toward the depressed position by moving with the door 200 while the closing operation of the door 200 is performed.

In the embodiment, the pressurizing protrusion 600 is exemplarily described as being provided to protrude from a rear surface of the sub door 220.

On the other hand, when the support 300 (refer to FIG. 1) and the folding guide device 500 are installed at the cabinet 100 (refer to FIG. 1), the pressurizing protrusion 600 may be installed at a rear surface of the main door 210.

In the embodiment, the pressurizing protrusion 600 includes a protrusion body 610 and a contactor 620.

The protrusion body 610 may be formed to have a shape that protrudes from the rear surface of the door 200, and the contactor 620 may be provided on an outer surface the protrusion body 610 and may come into contact with the slider 520.

The protrusion body 610 is formed of a metal material with high rigidity. The protrusion body 610 formed of the above-described material may not only have strong rigidity capable of remaining in a solid condition even when repeatedly used but also show a metallic color providing a beautiful surface effect highlighting a metallic feeling to provide an improved aesthetic.

The contactor 620 is formed of a material that reduces a coefficient of friction between the slider 520 and the contactor 620, for example, a material such as polyoxymethylene (POM) having a smooth surface, to smoothly and naturally perform sliding between the slider 520 and the pressurizing protrusion 600 while being in contact with the slider 520.

The pressurizing protrusion 600 including the above-described configuration has advantages including the high rigidity capable of remaining in the solid condition even when repeatedly used, an improved aesthetic provided by the metallic color providing the beautiful surface effect highlighting a metallic feeling, and smooth and natural sliding between the slider 520 and the pressurizing protrusion 600.

Meanwhile, in the embodiment, the folding guide device 500 and the pressurizing protrusion 600 are exemplarily described as being arranged at a pivoting center of the door 200, in more detail, at a position adjacent to the pivoting center, at which a pivotable combination between the sub door 220 that opens and closes the sub storage compartment 120 (refer to FIG. 1) and the main door 210 is performed.

When the folding guide device 500 and the pressurizing protrusion 600 are arranged at that position, the folding guide device 500 and the pressurizing protrusion 600 may more quickly respond to the pivoting of the door 200 in comparison to a case in which the folding guide device 500 and the pressurizing protrusion 600 are arranged at a side opposite thereto.

Accordingly, since the pivoting of the support 300 to be folded or unfolded is quickly performed while the opening and closing of the door 200 are performed, a collision between the support 300 and the door 200 occurs during an opening and closing process of the door 200, particularly, the closing operation of the door 200, and it is possible to effectively prevent the support 300 from being damaged.

Hereinafter, operations and effects of the refrigerator according to the embodiment and the folding guide device 500 provided therein will be described.

Hereinafter, an example in which the support 300 and the folding guide device 500 are installed at the main door 210 and the pressurizing protrusion 600 is installed at the sub door 220 will be described as an example.

Referring to FIGS. 1 and 14, when the sub door 220 is opened, the support 300 is positioned at the folded position and then is unfolded outward from the sub storage compartment 120.

In a state in which the support 300 is unfolded as described above, when a user opens the sub door 220 and takes a beverage or food out of the sub storage compartment 120, the withdrawn beverage or food may be put on the support 300.

That is, while the storage compartments 110 and 120 are filled with items, when taking items positioned deep inside the storage compartments 110 and 120 or changing positions thereof or pouring or moving a beverage or food stored in the storage compartments 110 and 120 into a cup or another container, it is possible to put a temporarily retrieved item on the support 300 without moving the items to another position. Accordingly, convenience and satisfaction of use according thereto may be improved.

When the user closes the sub door 220 while the support 300 is unfolded outward as described above, the sub door 220 pivots in a direction that closes the sub storage compartment 120. In this process, the pressurizing protrusion 600 installed to protrude from the rear surface of the sub door 220 pushes the slider 520 toward the depressed position as shown in FIG. 15.

When the slider 520 is moved toward the depressed position as described above, the rotating gear 531 is rotated in the one direction and the support 300 pivots upward due to the rotation of the rotating gear 531 in the one direction and is changed in position to the folded position.

When the sub door 220 pivots to a position for completely closing the sub storage compartment 120, the support 300 is in a state of being longitudinally erect in the sub storage compartment 120 (refer to FIG. 1) as shown in FIGS. 6 and 15.

Here, the support 300 is erect and tilts outward from the storage compartments 110 and 120 to receive a force in a direction for being laterally unfolded at the folded position, that is, for pivoting downward.

In this state, when the user pivots the sub door 220 to open the sub storage compartment 120, the support 300 that is longitudinally erect pivots downward due to its own weight, is changed in position to the unfolded position as shown in FIGS. 1 and 14, and is unfolded outward from the sub storage compartment 120.

Here, due to the above-described downward pivoting of the support 300, the rotating gear 531 pivots in the other direction. Due to the rotation of the rotating gear 531 in the other direction, the slider 520 returns to the protruding position again.

During a process through which the support 300 is unfolded as described above, since the elastic force is applied by the elastic pressurizer 440 at the initial state of the pivoting of the support 300 at which the moment is relatively weak and it is possible to push the support 300 with a stronger force, the downward pivoting of the support 300 for changing the position of the support 300 to the unfolded position may be smoothly performed.

Also, during the above-described process, the rotation of the rotating gear 531 in the other direction is transferred to the damper 550, and the damper 550 operates as resistance that reduces the rotation of the rotating in the other direction and the downward pivoting speed of the support 300.

Also, after the slider 520 is moved a certain distance toward the protruding position, the elastic supporter 540 applies the elastic force to the slider 520 in the direction that blocks the movement of the slider 520, and the elastic force applied to the slider 520 as described above also operates as resistance that reduces the rotation of the rotating gear 531 in the other direction and the downward pivoting speed of the support 300.

Accordingly, at a later stage of the pivoting of the support 300 at which the moment is relatively strong, a force including the damping force of the damper 550 and the elastic force of the elastic supporter 540 is applied as a force that reduces the rotational force of the support 300 in such a way that the pivoting speed of the support 300 may be reduced, the support 300 may be smoothly unfolded, and the movement of the support 300 may be effectively suppressed during or after the process through which the support 300 is unfolded.

When taking items positioned deep inside the storage compartments 110 and 120 to change positions thereof or pouring or moving a beverage or food stored in the storage compartments 110 and 120 into a cup or to another container while the storage compartments 110 and 120 are filled with items, the refrigerator according to the embodiment that includes the above-described configuration may improve convenience and satisfaction in use felt by the user by providing a holding structure such as the support 300 for temporarily putting items thereon.

Also, the refrigerator according to the embodiment and the folding guide device 500 provided therein provide an advantage in that the user may conveniently use the support 300 by allowing the support 300 to be automatically unfolded or folded in conjunction with the opening and closing operation of the door 200 without directly unfolding or folding the support 300 by hand.

Also, the refrigerator according to the embodiment and the folding guide device 500 provided therein provides an advantage in that not only is the support 300 smoothly unfoldable but also a movement of the support 300 is prevented while being unfolded using the components such as the damper 550 and the elastic supporter 540 for reducing the downward pivoting speed of the support 300, thereby effectively buffering a shock that may be received when the support 300 is unfolded and allowing the user to feel comfortable in use.

According to the refrigerator according to the embodiment of the present invention and the folding guide device provided therein, when taking items positioned deep inside the storage compartments to change positions thereof or pouring or moving a beverage or food stored in the storage compartments into a cup or to another container while the storage compartments are filled with items, convenience and satisfaction in use felt by the user may be improved by providing a holding structure such as the support for temporarily putting items thereon.

Also, according to the embodiment, since the support is interlinked with the opening and closing operation of the door to be automatically unfolded or folded, the user may conveniently use the support without directly unfolding or folding the support.

Also, according to the embodiment, since not only is the support smoothly unfoldable but also a movement of the support is suppressed, a shock that may be received when the support is unfolded may be effectively buffered to allow the user to use the support with a comfortable feeling.

Although the present invention has been described with reference to the embodiments shown in the drawings, it should be understood that the embodiments are merely examples and various modifications and equivalents thereof may be made by one of ordinary skill in the art. Accordingly, the technical scope of the present invention should be defined by the following claims.

What is claimed is:

1. A refrigerator comprising:

a body that defines a storage compartment;

a door configured to open and close at least a portion of the storage compartment;

a support that is rotatably coupled to the body or to the door, that is configured to rotate to an unfolded position in which the support protrudes outward from the storage compartment, and that is configured to rotate to a folded position in which at least a portion of the support remains within the storage compartment; and a folding guide device that is configured to provide a rotational force to the support based on opening and closing of the door, wherein the folding guide device comprises:

a slider that is configured to linearly move toward the storage compartment based on the door pressing the slider, and a conversion outputter that connects the slider to the support, the conversion outputter being configured to convert linear movement of the slider to rotational force for rotating the support to the folded position, and wherein the support is configured to, based on being in the folded position, be disposed at a position that is titled outward from the storage compartment, and receive force for rotating in a direction to the unfolded position.

2. The refrigerator of claim 1, further comprising a position maintainer that is configured to limit rotation of the support based on the support being in one of the unfolded position and the folded position.

3. The refrigerator of claim 2, wherein the position maintainer includes an elastic pressurizer that is configured to provide an elastic force to the support, the support being configured to rotate to a tilted position outward from the storage compartment relative to the folded position.

4. The refrigerator of claim 3, wherein the position maintainer further includes:

a lateral supporting wall that extends in a lateral direction across the storage compartment, the lateral supporting wall being configured to support a bottom surface of the support based on the support being oriented in the unfolded position; and a longitudinal supporting wall that extends downward from the lateral supporting wall, the longitudinal supporting wall being configured to support the bottom surface of the support based on the support being oriented in the folded position, wherein the elastic pressurizer is provided on the longitudinal supporting wall, the elastic pressurizer being configured to be pressed by the bottom surface of the support based on the support being oriented in the folded position.

5. The refrigerator of claim 4, wherein the position maintainer further includes a supporting rib that is located rearward of the longitudinal supporting wall, that extends in the lateral direction, and that is configured to support a top surface of the support to limit rotation of the support based on the support being oriented in the unfolded position.

6. The refrigerator of claim 1, further comprising a pressurizing protrusion that is located at the door and that is configured to press the slider.

7. The refrigerator of claim 6, wherein the pressurizing protrusion comprises:

a protrusion body protruding from a rear surface of the door; and a contactor provided on an outer surface of the protrusion body and configured to contact the slider.

8. The refrigerator of claim 7, wherein the protrusion body is made of a metal to provide a high rigidity to the pressurizing protrusion, and wherein the contactor is made of a polymer having a low coefficient of friction between the slider and the contactor.

9. A folding guide device comprising:

a slider that is configured to linearly move toward a storage compartment based on being pressed by a door, the door being configured to open and close at least a portion of the storage compartment; and a conversion outputter that connects the slider to a support, the support being rotatably provided in the storage compartment, wherein the conversion outputter is configured to convert a linear movement of the slider to rotation of the support and to convert rotation of the support to a linear movement of the slider, wherein the slider is configured to linearly move, toward the door, to a protruding position based on the door being opened, wherein the slider is configured to linearly move, toward the storage compartment, to a depressed position based on the door being closed, wherein the conversion outputter is configured to provide a rotational force to the support in a first direction that causes the support to rotate, toward the storage compartment, to a folded position based on the slider moving toward the depressed position, wherein the conversion outputter is configured to provide a linear force to the slider to return to the protruding position toward the door based on the support rotating in a second direction opposite the first direction to an unfolded position, wherein the folding guide device further comprises a damper that is configured to provide a damping force to reduce the rotational force provided to the support, and wherein the folding guide device further comprises elastic supporters that are configured to provide an elastic force for restricting a linear movement of the slider toward the protruding position.

10. The folding guide device of claim 9, wherein the elastic supporters are configured to provide the elastic force to the slider after the slider has moved by a predetermined distance from the depressed position toward the protruding position.

11. The folding guide device of claim 9, further comprising:

a case that accommodates the conversion outputter and the elastic supporters, the slider being movably accommodated in the case;

guide pins located within the case and slidably coupled to the slider, the guide pins being configured to guide a movement of the slider between the protruding position and the depressed position; and a combiner connected to the slider and configured to receive the guide pins.

12. The folding guide device of claim 11, wherein the elastic supporters are configured to provide the elastic force to the combiner that is connected to the slider.

13. The folding guide device of claim 12, wherein each of the elastic supporters comprises a coil spring that surrounds at least a portion of one of the guide pins, and wherein the coil spring is configured to be compressed by the combiner based on the slider moving toward the protruding position.

14. The folding guide device of claim 13, wherein the coil spring is positioned between the combiner and a wall surface of the case, the slider being positioned vertically below the wall surface of the case.

15. The folding guide device of claim 13, wherein each of the guide pins comprises:

a spring mounting pin, the coil spring surrounding at least a portion of the spring mounting pin; and a sliding pin that is slidably coupled to the combiner.

16. The folding guide device of claim 15, wherein the guide pins further comprise a pair of spring mounting pins spaced apart from each other by a predetermined distance, and wherein the sliding pin is disposed between the pair of spring mounting pins.

17. The folding guide device of claim 16, wherein the combiner defines first through holes configured to receive the spring mounting pins and a second through hole configured to receive the sliding pin, and wherein an inner circumferential surface of the second through hole contacts an outer surface of the sliding pin.

18. The folding guide device of claim 17, wherein each of the first through holes includes:

a through hole configured to receive the spring mounting pin; and an extension hole stepped radially outward from the through hole, the extension hole being configured to receive the spring mounting pin and the coil spring surrounding the spring mounting pin.

19. The refrigerator of claim 1, wherein the support is configured to, based on a weight of the support, rotate in the direction to the unfolded position from the position that is titled outward from the storage compartment.

20. The refrigerator of claim 1, wherein the slider is configured to:

based on the door being opened, move to a protruding position in a first horizontal direction toward the door, and based on the door being closed, move to a depressed position in a second horizontal direction toward the storage compartment.

* * * * *